US010458188B2

(12) United States Patent
Bomidi et al.

(10) Patent No.: US 10,458,188 B2
(45) Date of Patent: Oct. 29, 2019

(54) CUTTING ELEMENT ASSEMBLIES COMPRISING ROTATABLE CUTTING ELEMENTS, EARTH-BORING TOOLS INCLUDING SUCH CUTTING ELEMENT ASSEMBLIES, AND RELATED METHODS

(71) Applicant: Baker Hughes, a GE company, LLC, Houston, TX (US)

(72) Inventors: John Abhishek Raj Bomidi, Spring, TX (US); Jon David Schroder, The Woodlands, TX (US); Kegan L. Lovelace, Houston, TX (US); William A. Moss, Jr., Conroe, TX (US); Alexander Rodney Boehm, Wheat Ridge, CO (US)

(73) Assignee: Baker Hughes, a GE company, LLC, Houston, TX (US)

( * ) Notice: Subject to any disclaimer, the term of this patent is extended or adjusted under 35 U.S.C. 154(b) by 155 days.

(21) Appl. No.: 15/795,009

(22) Filed: Oct. 26, 2017

(65) Prior Publication Data

US 2019/0128073 A1 May 2, 2019

(51) Int. Cl.

| | |
|---|---|
| ***E21B 10/43*** | (2006.01) |
| ***E21B 10/54*** | (2006.01) |
| ***E21B 10/573*** | (2006.01) |
| ***E21B 10/627*** | (2006.01) |

(52) U.S. Cl.

CPC ..... *E21B 10/43* (2013.01); *E21B 10/54* (2013.01); *E21B 10/5735* (2013.01); *E21B 10/627* (2013.01); *E21B 2010/545* (2013.01)

(58) Field of Classification Search

CPC ..... E21B 10/43; E21B 10/54; E21B 10/5735; E21B 10/50; E21B 2010/545; E21B 10/627

See application file for complete search history.

(56) References Cited

U.S. PATENT DOCUMENTS

| | | | |
|---|---|---|---|
| 3,870,370 | A | 3/1975 | Winberg et al. |
| 4,751,972 | A | 6/1988 | Jones et al. |
| 4,760,890 | A | 8/1988 | Saxman |
| 8,091,655 | B2 | 1/2012 | Shen et al. |

(Continued)

OTHER PUBLICATIONS

International Written Opinion for International Application No. PCT/US2018/057028 dated Mar. 12, 2019, 7 pages.

(Continued)

*Primary Examiner* — Michael R Wills, III
(74) *Attorney, Agent, or Firm* — TraskBritt

(57) ABSTRACT

A cutting element assembly may include a support structure and a pin having a cylindrical exterior bearing surface. Retention elements may couple opposing ends of the pin to the support structure. The cutting element assembly also includes a rotatable cutting element including a table of polycrystalline hard material having an end cutting surface and a supporting substrate. The rotatable cutting element may have an interior sidewall defining a longitudinally extending through hole. The pin may be positioned within the through hole of the rotatable cutting element and may be supported on the opposing ends thereof by the support structure. Methods include drilling a subterranean formation including engaging a formation with one or more of the rotatable cutting elements.

20 Claims, 4 Drawing Sheets

(56) References Cited

U.S. PATENT DOCUMENTS

| | | | | |
|---|---|---|---|---|
| 8,499,859 | B1 * | 8/2013 | Cooley | E21B 10/55 175/382 |
| 8,991,523 | B2 | 3/2015 | Shen et al. | |
| 9,091,132 | B1 * | 7/2015 | Cooley | E21B 10/573 |
| 9,187,962 | B2 * | 11/2015 | Burhan | E21B 10/54 |
| 9,322,219 | B2 | 4/2016 | Burhan et al. | |
| 9,388,639 | B2 | 7/2016 | Patel et al. | |
| 9,399,892 | B2 * | 7/2016 | Do | E21B 10/627 |
| 2014/0326515 | A1 | 11/2014 | Shi et al. | |
| 2014/0360792 | A1 * | 12/2014 | Azar | E21B 10/62 175/432 |
| 2016/0153243 | A1 | 6/2016 | Hinz et al. | |
| 2016/0290056 | A1 * | 10/2016 | Propes | E21B 10/43 |

OTHER PUBLICATIONS

International Search Report for International Application No. PCT/US2018/057028 dated Mar. 12, 2019, 3 pages.

* cited by examiner

CUTTING ELEMENT ASSEMBLIES COMPRISING ROTATABLE CUTTING ELEMENTS, EARTH-BORING TOOLS INCLUDING SUCH CUTTING ELEMENT ASSEMBLIES, AND RELATED METHODS

FIELD

Embodiments of the present disclosure relate generally to rotatable cutting elements, earth-boring tools including such cutting elements, and related methods.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on the body of a drill bit by brazing. The drill bit body is formed with recesses therein, commonly termed "pockets," for receiving a substantial portion of each cutting element in a manner that presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element to raise the temperature to a point high enough to braze the cutting elements to the bit body in a fixed position but not so high as to damage the PCD layer.

Unfortunately, securing a PDC cutting element to a drill bit restricts the useful life of such cutting element, as the cutting edge of the diamond table wears down as does the substrate, creating a so-called "wear flat" and necessitating increased weight on bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Rotatable cutting elements mounted for rotation about a longitudinal axis of the cutting element can be made to rotate by mounting them at an angle in the plane in which the cutting elements are rotating (side rake angle). This will allow them to wear more evenly than fixed cutting elements, having a more uniform distribution of heat across and heat dissipation from the surface of the PDC table and exhibit a significantly longer useful life without removal from the drill bit. That is, as a cutting element rotates in a bit body, different parts of the cutting edges or surfaces of the PDC table may be exposed at different times, such that more of the cutting element is used. Thus, rotatable cutting elements may have a longer life than fixed cutting elements.

Additionally, rotatable cutting elements may mitigate the problem of "bit balling," which is the buildup of debris adjacent to the edge of the cutting face of the PDC table. As the PDC table rotates, the debris built up at the edge of the PDC table in contact with a subterranean formation may be forced away as the PDC table rotates.

BRIEF SUMMARY

In one embodiment of the disclosure, a cutting element assembly includes a support structure and a pin having a cylindrical exterior bearing surface. Retention elements may couple opposing ends of the pin to the support structure. The cutting element assembly also includes a rotatable cutting element including a table of polycrystalline hard material having an end cutting surface and a supporting substrate. The rotatable cutting element may have an interior sidewall defining a longitudinally extending through hole. The pin may be positioned within the through hole of the rotatable cutting element and may be supported on the opposing ends thereof by the support structure.

In another embodiment of the disclosure, an earth-boring tool includes a body and a cutting element assembly. The cutting element assembly includes a support structure and a pin having a cylindrical exterior bearing surface. Retention elements may couple opposing ends of the pin to the support structure. The cutting element assembly also includes a rotatable cutting element including a table of polycrystalline hard material having an end cutting surface and a supporting substrate. The rotatable cutting element may have an interior sidewall defining a longitudinally extending through hole. The pin may be positioned within the through hole of the rotatable cutting element and may be supported on the opposing ends thereof by the support structure.

In a further embodiment of the disclosure, a method of drilling a subterranean formation includes applying weight-on-bit to an earth-boring tool disposed within a wellbore substantially along a longitudinal axis thereof and rotating the earth-boring tool. The method also includes engaging a formation with rotatable cutting elements located on blades of the earth-boring tool. The rotatable cutting elements may be rotatably secured within pockets of the blades with pins extending through a through hole of each of the rotatable cutting elements. Each of the pins may be coupled on opposing ends thereof to a support structure located within a respective pocket of the blades. The method may also include absorbing compressive forces imposed on the rotatable cutting elements with the support structure.

DETAILED DESCRIPTION

Figure 1:
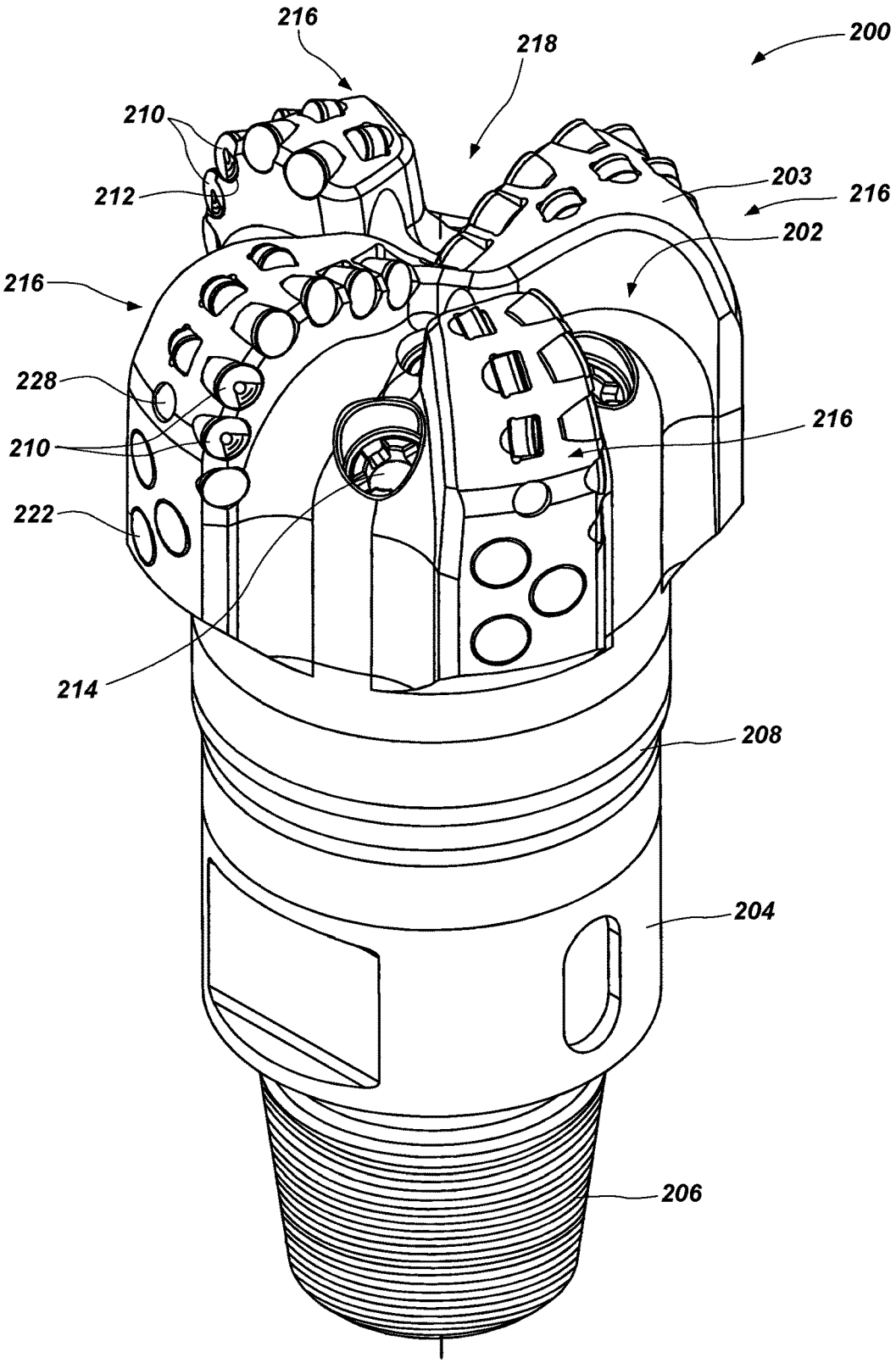
FIG. 1 is a simplified perspective view of a fixed-blade earth-boring rotary drill bit.

The illustrations presented herein are not actual views of any particular tool or drill string, but are merely idealized representations that are employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature or method act indicates that such is contemplated for use in implementation of an embodiment of the disclosure, and such term is used in preference to the more restrictive term "is" so as to avoid any implication that other, compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $Kg_f/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a perspective view of a fixed-cutter earth-boring rotary drill bit 200. The drill bit 200 includes a bit body 202 that may be secured to a shank 204 having a threaded connection portion 206 (e.g., an American Petroleum Institute (API) threaded connection portion) for attaching the drill bit 200 to a drill string. In some embodiments, the bit body 202 may be secured to the shank 204 using an extension 208. In other embodiments, the bit body 202 may be secured directly to the shank 204.

The bit body 202 may include internal fluid passageways that extend between a face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutters, as described below and shown in FIGS. 2-5.

Figure 2:
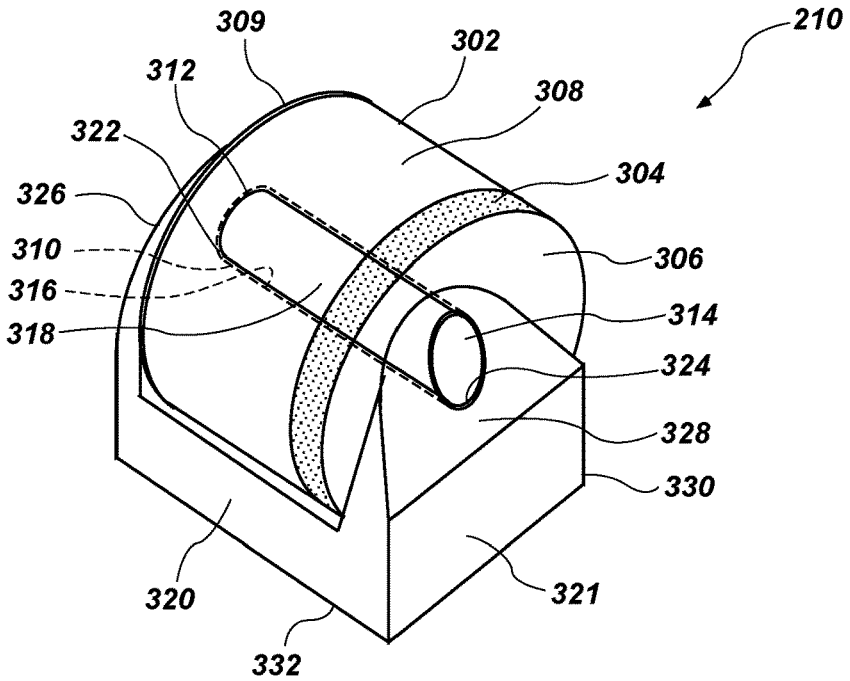
FIG. 2 is a simplified perspective view of one embodiment of a cutting element assembly that may be used in conjunction with a rotatable cutting element.

FIG. 2 shows a simplified perspective view of one embodiment of one of the cutting element assemblies 210 shown in FIG. 1. The cutting element assembly 210 may include cutting elements, such as a rotatable cutting element 302. The rotatable cutting element 302 may include a table 304 having an end cutting surface 306. The table 304 may be bonded to a substrate 308 having a bearing surface 309 opposite the end cutting surface 306. The rotatable cutting element 302 may include a through hole 310 defined by an interior sidewall 316 thereof. The through hole 310 has a proximal end 312 at the bearing surface 309 of the substrate 308 and a distal end 314 at the end cutting surface 306 of the table 304.

The cutting element assembly 210 also includes a support structure 320 for retaining the rotatable cutting element 302. The support structure 320 may be brazed or fastened within a respective cutting element pocket 212 of the blades 216 of the bit body 202 (FIG. 1). The support structure 320 may include a base 321. In some embodiments, the base 321 may be substantially planar. In other embodiments, the base 321 may include curved surfaces (e.g., concave or convex) in order to conform to exterior surfaces of the rotatable cutting element 302 and/or to interior surfaces of the cutting element pockets 212 of the blades 216 (FIG. 1). For example, a surface of the base 321 adjacent the rotatable cutting element 302 may have a concave shape. The base 321 may include a first side 330 and an opposing second side 332. In some embodiments, a shape of the second side 332 may differ from a shape of the first side 330, as discussed in greater detail in connection with FIG. 3.

The support structure 320 may also include side support structures attached to or integrally formed with the base 321. For example, a side support structure 326 may be located on a proximal end of the base 321 and a side support structure 328 may be located on a distal end of the base 321, each of the side support structures 326, 328 extending generally transverse to the base 321. The side support structures 326, 328 may include an opening (e.g., blind bore or through hole) being sized and positioned to receive an end of a pin 318, as discussed in greater detail below. In some embodiments, the side support structures 326, 328 may be substantially planar, having a substantially uniform thickness. In other embodiments, at least a portion of the side support structures 326, 328 may be tapered and/or inclined inward toward the interior of the support structure 320, as shown in FIG. 2. In addition, the side support structure 326 may be located proximate to and at least partially cover a portion of the bearing surface 309 of the substrate 308 of the rotatable cutting element 302. The side support structure 328 may be located proximate to and at least partially extending over (e.g., covering) a portion of the end cutting surface 306 of the table 304 of the rotatable cutting element 302.

Materials of the support structure 320 may include a metal carbide or steel material (e.g., high-strength steel alloy). For example, the support structure 320, including the base 321 and the side support structures 326, 328, may include materials such as tungsten carbide, tantalum carbide, or titanium carbide. Additionally, various binding metals may be included in the support structure 320, such as cobalt, nickel, iron, metal alloys, or mixtures thereof, such that metal carbide grains may be supported within the metallic binder. In some embodiments, the support structure 320 may be formed of the same material as the cutting element pockets 212, while in other embodiments, the support structure 320 may be formed of a different material than that of the cutting element pockets 212. In some embodiments, an outer surface of the side support structure 328 (i.e., proximate an engaged formation) may include a hard material (e.g., polycrystalline hard material) similar to that of the end cutting surface 306 of the table 304 of the rotatable cutting element 302.

The pin 318 may be a cylindrical-shaped bearing pin sized and shaped to conform with the interior sidewall 316 defining the through hole 310 of the rotatable cutting element 302. The pin 318 may be configured to reduce frictional forces and/or binding as the rotatable cutting element 302 rotates about a longitudinal axis thereof relative to the pin 318. In some embodiments, the pin 318 may include a friction-reducing surface, such as a bearing. For example, the pin 318 may function as a journal bearing, a roller bearing (e.g., needle bearings) or the like. In some embodiments, the pin 318 may include a journal bearing between the rotatable cutting element 302 and the support structure 320. In other embodiments, the pin 318 may include an elongated cylindrical body having a hard and smooth finished exterior surface such that when the rotatable cutting element 302 rotates about the pin 318, the interior sidewall 316 of the rotatable cutting element 302 is in sliding contact with bearing surfaces of the pin 318. Materials of the pin 318 may include, for example, a metal carbide (e.g., tungsten carbide), aluminum, or steel material (e.g., steel alloy). In addition, the pin 318 and/or the interior sidewall 316 may include a diamond-like coating or other low-friction material to provide such bearing surfaces between the pin 318 and the rotatable cutting element 302.

In operation, the pin 318 is located in the through hole 310 of the rotatable cutting element 302 and the pin 318 is secured to the support structure 320. The pin 318 may be fixedly coupled to and simply supported on opposing ends by each of the side support structures 326, 328 and the rotatable cutting element 302 is free to rotate about the pin 318. For example, the rotatable cutting element 302 may be retained within the support structure 320 in an orientation such that the proximal end 312 of the through hole 310 at the bearing surface 309 of the substrate 308 may be located proximate the side support structure 326, while the distal end 314 of the through hole 310 at the end cutting surface 306 of the table 304 may be located proximate the side support structure 328. Thus, the rotatable cutting element 302 may be rotatably secured to the support structure 320 utilizing the pin 318.

The ends of the pin 318 may be permanently or removably coupled to the support structure 320. Opposing ends of the pin 318 may be attached (e.g., fastened) to the side support structures 326, 328 using retention elements. For example, a proximal end of the pin 318 may be coupled to the side support structure 326 using a retention element 322, while a distal end of the pin 318 may be coupled to the side support structure 328 using a retention element 324. In some embodiments, the retention elements 322, 324 may include braze material, for example, to permanently and/or removably couple the pin 318 to the support structure 320 and to restrict relative movement therebetween. In other embodiments, the retention elements 322, 324 may include threaded fasteners having complementary threaded surfaces on each of the pin 318 and the side support structures 326, 328. Such threaded fasteners may also include locking devices (e.g., nuts or washers) located thereon to prevent such threaded fasteners from becoming loosened. In yet other embodiments, the retention elements 322, 324 may include weld material, adhesive, locking mechanisms, such as interference fit (e.g., shrink-fitting or press-fitting), mechanical fasteners (e.g., snap rings) or the like to facilitate removable attachment between the pin 318 and the side support structures 326, 328. In some embodiments, the support structure 320 including the retention elements 322, 324 may be located only within (i.e., without extending beyond) the cutting element pocket 212 (FIG. 1). In other embodiments, the support structure 320 may extend beyond the cutting element pocket 212. It may be appreciated that any type of retention elements 322, 324 may be utilized to support the pin 318 and to protect the rotatable cutting element 302 against forces experienced while drilling. Of course, a person of ordinary skill in the art would recognize that lateral support of the rotatable cutting element 302 would be desirable in order to protect against impact damage and/or to support the rotatable cutting element 302 located within the cutting element pockets 212 machined (e.g., in steel bodies) or otherwise formed in the blades 216 of the bit body 202 (FIG. 1). In particular, when the rotatable cutting element 302 engages a formation, the compressive forces acting thereon may be absorbed by the support structure 320 and/or the pin 318 when the pin 318 is affixed to the side support structures 326, 328. Such a configuration may provide additional structural support to the rotatable cutting element 302 utilizing the pin 318 without inducing bending and/or angular misalignment of the pin 318.

Figure 3:
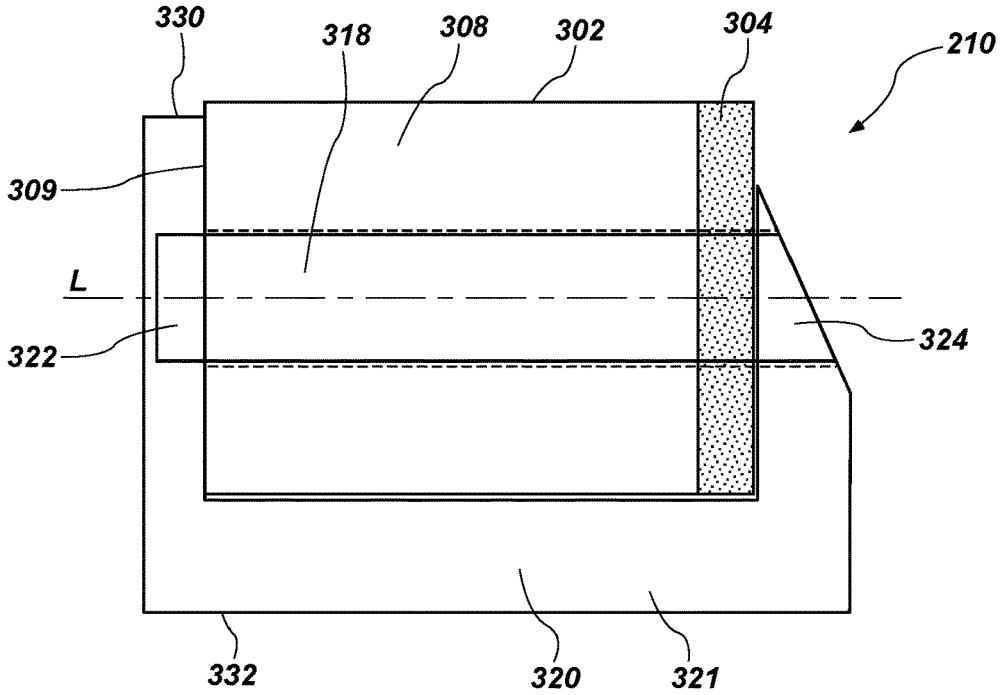
FIG. 3 is a simplified top view of the embodiment of the cutting element assembly shown in FIG. 2.

FIG. 3 shows a simplified top view of the embodiment of the cutting element assembly 210 shown in FIG. 2. The rotatable cutting element 302 is held in position relative to the support structure 320 utilizing the pin 318, such that the rotatable cutting element 302 rotates about the pin 318 that is fixed relative to the support structure 320. The retention elements 322, 324 may be utilized to facilitate attachment of opposing ends thereof to the support structure 320 utilizing side support structures 326, 328. As described in greater detail above with reference to FIG. 2, the retention elements 322, 324 may include, for example, braze material, threaded portions, or locking mechanisms (e.g., snap rings). In some embodiments the retention element 322 may be the same as the retention element 324. In other embodiments, the retention element 322 may be different than the retention element 324. For example, the retention element 322 may include compatible threaded portions or other alternatives, such as friction fit, between the pin 318 and the side support structure 326, while the retention element 324 may include braze material. Thus, the retention elements 322, 324 may provide sufficient force to retain the pin 318 within the support structure 320 under normal operating conditions, but the pin 318 may still be removed from the support structure 320, if necessary, for repair and/or replacement.

In some embodiments, an outer side surface of the base 321 of the support structure 320 may not extend beyond an outer side surface of the rotatable cutting element 302 on the first side 330 of the support structure 320 as viewed from the top view of FIG. 3, while an outer side surface of the base 321 of the support structure 320 may extend beyond an outer side surface of the rotatable cutting element 302 on the second side 332 of the support structure 320. In other words, the first side 330 and the second side 332 of the base 321 may be asymmetric with respect to a longitudinal axis L of the rotatable cutting element 302. In such an embodiment, each of the side support structures 326, 328 may also be asymmetric with respect to the longitudinal axis L of the rotatable cutting element 302, each of the side support structures 326, 328 having an elongated portion proximate the second side 332 of the support structure 320 relative to the portion proximate the first side 330 of the support structure 320. Further, the base 321 proximate the substrate 308 and the retention element 322 (i.e., proximal end) may be symmetric with respect to the longitudinal axis L of the rotatable cutting element 302, while the base 321 proximate the table 304 and the retention element 324 (i.e., distal end) may be asymmetric with respect to the longitudinal axis L of the rotatable cutting element 302.

As shown in FIG. 3 in combination with FIG. 1, a leading edge of the base 321 located between the retention element 324 and the first side 330 thereof may be tapered (e.g., reduced at the ends), for example, in order to accommodate placement of the cutting element assembly 210 within the cutting element pockets 212 of the blades 216 and to facilitate proper exposure of the end cutting surface 306 of the table 304 of the rotatable cutting element 302 relative to an engaged formation. In particular, as shown in the embodiment shown in FIG. 3, the support structure 320 may be sized and shaped to facilitate the table 304 having a greater exposure relative to an exposure of the substrate 308.

Once the rotatable cutting element 302 is coupled to the support structure 320, the support structure 320 may be coupled to the bit body 202 (FIG. 1) within the cutting element pockets 212 of the blades 216 using similar retention elements (e.g., braze material). Alternatively, the rotatable cutting element 302 may be removably secured to the support structure 320 once the support structure 320 has been permanently or removably secured to the bit body 202. In other words, the pin 318 may be configured to enable movable attachment of the rotatable cutting element 302 to the support structure 320 and, thus, the bit body 202 during drilling operations, while being configured to facilitate ease of replacement of damaged parts and/or interchangeable components to accommodate differing drilling conditions. Thus, the rotatable cutting element 302 and/or the support structure 320 may be removable and/or replaceable without incurring substantial damage to the bit body 202. In other embodiments, the support structure 320 may be integrally formed with the blade 216, such that there is no physical interface between the support structure 320 and the blade 216. In yet other embodiments, the opposing ends of the pin 318 may be directly coupled within the cutting element pockets 212 of the blades 216 using similar retention elements (e.g., braze material).

In embodiments of the present disclosure, the cutting element assemblies 210 including the rotatable cutting element 302 may include selective placement relative to the number and placement of fixed cutting elements. In other words, it is contemplated that the rotatable cutting elements 302 may be selectively positioned relative to one another on the blades 216 (FIG. 1). Further, the number of cutters (i.e., cutter density) may remain the same or may differ from that of conventional blades in order to accommodate selective placement of the cutting element assemblies 210 including the rotatable cutting element 302 among fixed cutting elements. In some embodiments, placement and exposure of the fixed cutting elements may be maintained. In other words, an original bit design may not change with the exception of replacing one or more fixed cutting elements with the cutting element assemblies 210 including the rotatable cutting element 302 in selected locations (e.g., cone, nose, shoulder, or gage regions) of the bit body 202. In some embodiments, the rotatable cutting elements 302 may be positioned proximate a front cutting edge of a respective blade 216 (e.g., at a rotationally leading edge of the blades 216). In some embodiments, one or more (e.g., two) of the rotatable cutting elements 302 may be positioned proximate one another on each of the blades 216 and may be disposed at selected locations (e.g., shoulder or gage regions) rotationally leading fixed cutting elements on the same blade 216.

Figure 4:
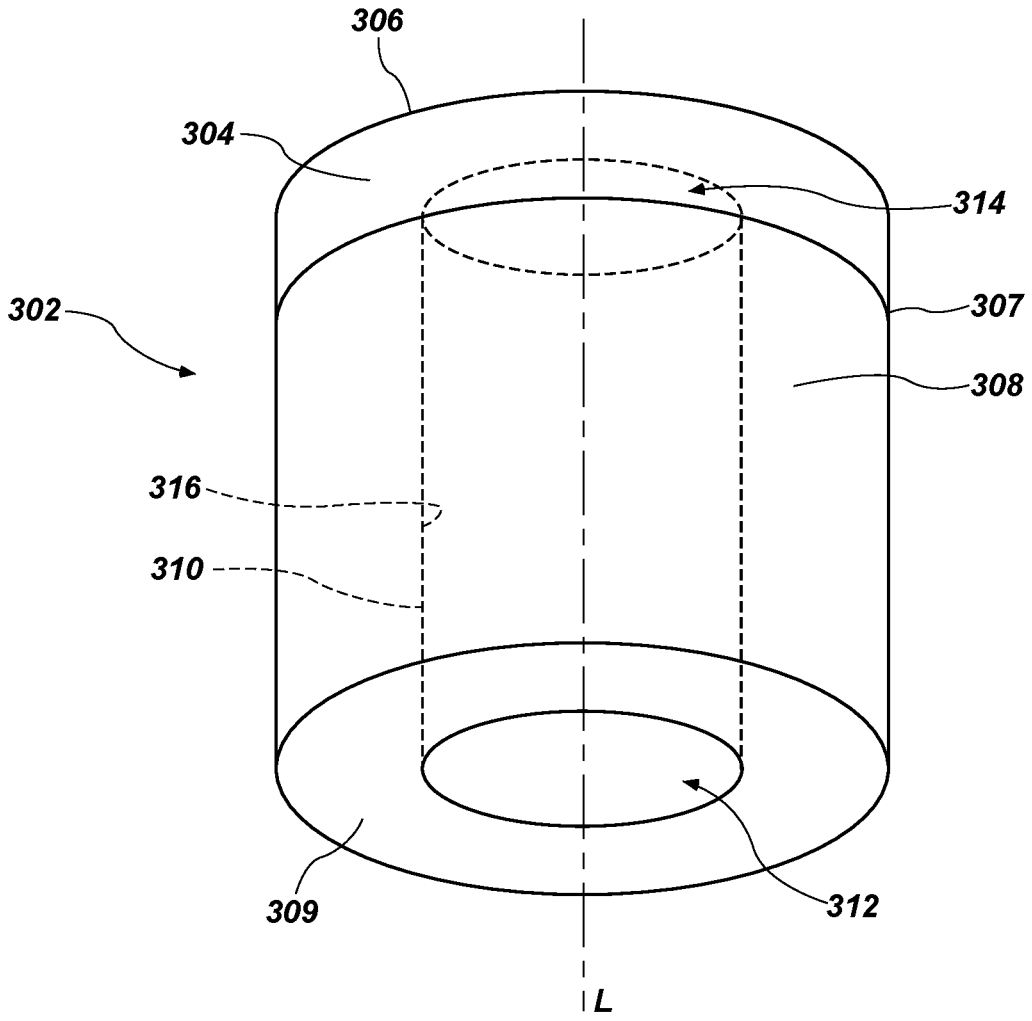
FIG. 4 is a simplified perspective view of a rotatable cutting element that may be used in cutting element assemblies as shown in FIGS. 2 and 3.

FIG. 4 is a simplified perspective view of one embodiment of the rotatable cutting element 302. The rotatable cutting element 302 may be used, for example, in the cutting element assemblies 210 shown in FIGS. 2 and 3. The rotatable cutting element 302 may include the table 304 (e.g., a table of polycrystalline hard material) bonded to the substrate 308 at an interface 307. The table 304 may include diamond, cubic boron nitride, or another hard material. The substrate 308 may include, for example, cobalt-cemented tungsten carbide or another carbide material. The table 304 includes the end cutting surface 306, and may also have other surfaces, such as side surfaces, chamfers, etc., at a peripheral cutting edge of the table 304, which surfaces contact a subterranean formation when the rotatable cutting element 302 is used to form or service a wellbore. The table 304 may be generally cylindrical, and the interface 307 may be generally parallel to the end cutting surface 306. The substrate 308 includes the bearing surface 309 on an end thereof, opposite the interface 307. In this embodiment, the bearing surface 309 may be planar and annular. In addition, the end cutting surface 306 of the table 304 may be planar and annular. In other embodiments, the bearing surface 309 and/or the end cutting surface may be nonplanar. For example, the end cutting surface may include a nonplanar, convex cutting table not having a flat cutting face (e.g., dome-shaped, cone-shaped, chisel-shaped, etc.). Further, the end cutting surface 306 may include facets (e.g., shaped features or differently polished regions) to induce rotation of the rotatable cutting element 302. In some embodiments, the end cutting surface 306 may be treated (e.g., polished) to exhibit a reduced surface roughness.

Interior surfaces of the substrate 308 of the rotatable cutting element 302 may generally define the through hole 310 (e.g., longitudinally extending) having the proximal end 312 at the bearing surface 309 of the substrate 308 and having the distal end 314 at the end cutting surface 306 of the table 304. In other words, the through hole 310 may extend through the entire rotatable cutting element 302 from the bearing surface 309 of the substrate 308 to the end cutting surface 306 of the table 304. The through hole 310 may be defined by the interior sidewall 316 of the rotatable cutting element 302 and may be generally centered along the longitudinal axis L of the rotatable cutting element 302. The through hole 310 may impart an annular cross-sectional shape to the rotatable cutting element 302. The pin 318 mates with the corresponding through hole 310 such that when the rotatable cutting element 302 rotates about the pin 318, the interior sidewall 316 may substantially conform to exterior surfaces of the pin 318, as discussed in greater detail in connection with FIG. 2. In some embodiments, the interior sidewall 316 defining the through hole 310 may have an entirely smooth contour. In other embodiments, at least a portion of the interior sidewall 316 may include structures (e.g., channels, grooves, protrusions, threads, etc.) formed therein to facilitate retention and/or alignment of the rotatable cutting element 302 with respect to the pin 318. Such structures may align with complementary structures on an exterior surface of the pin 318.

Figure 5:
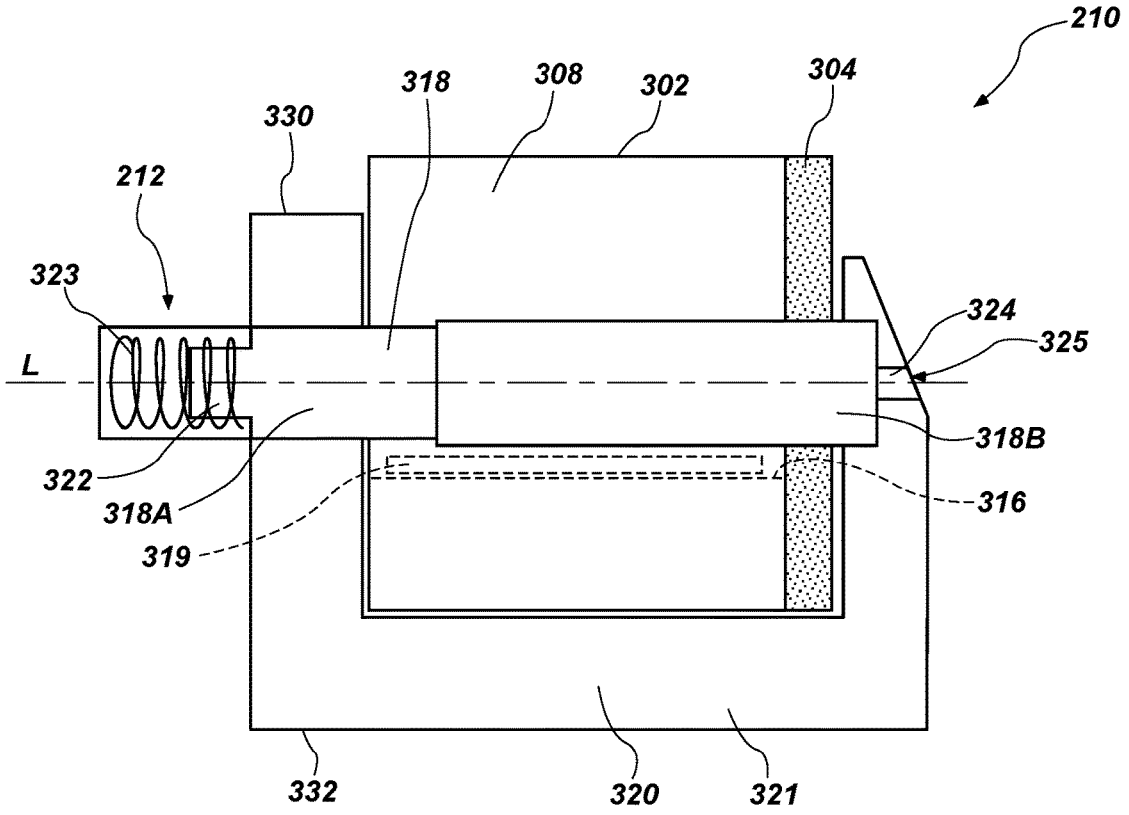
FIG. 5 is a simplified perspective view of another embodiment of a cutting element assembly that may be used in conjunction with a rotatable cutting element, such as the one shown in FIG. 4.

FIG. 5 shows a simplified perspective view of another embodiment of the cutting element assembly 210 that may be used in conjunction with a rotatable cutting element, such as the rotatable cutting element 302 shown in FIG. 4. Many parts, such as the side support structures 326, 328 of the support structure 320 and the like, which are same as those included in the embodiment of the cutting element assembly 210 of FIGS. 2 and 3 are not repeated here. As in the previous embodiment, the rotatable cutting element 302 may be held in position relative to the support structure 320 utilizing the pin 318, such that the rotatable cutting element 302 rotates about a longitudinal axis thereof relative to the pin 318 and the support structure 320.

The difference of the embodiment of FIG. 5 lies in a specific structure for retaining the pin 318 within the support structure 320. Here, the retention elements 322, 324 may include a pin 318 that is collapsible. For example, the pin 318 may include a split shaft configuration including an inner shaft portion 318A and an outer shaft portion 318B. In such a configuration, the inner shaft portion 318A may be slidably engaged within the outer shaft portion 318B. Interaction between the inner shaft portion 318A and the outer shaft portion 318B may be designed to facilitate retention of the pin 318 and, thus, the rotatable cutting element 302 within the support structure 320 during drilling operations, while allowing removal of such components during replacement thereof. In other embodiments, the inner shaft portion 318A and the outer shaft portion 318B may otherwise collapse relative to one another and may or may not be of similar size (e.g., outer diameter). In some embodiments, roller bearings 319 (e.g., needle bearings) may optionally be included between (e.g., in rolling contact with) an outer surface of the pin 318 and the interior sidewall 316 of the rotatable cutting element 302. As a result, the roller bearings 319 may transfer radial and axial forces acting on the rotatable cutting element 302 to the support structure 320 via the pin 318.

In the embodiment of FIG. 5, the retention element 322 may be different than the retention element 324. For example, the cutting element assembly may include a spring 323 and a port 325. The spring 323 may be located between a protruding portion on the proximal end of the pin 318 and an interior surface of a respective cutting element pocket 212 (FIG. 1). The spring 323 (e.g., compression spring) may be removably or permanently attached or may be integrally formed with the protruding portion on the proximal end of the pin 318. The port 325 may be located in the side support structure 328 such that at least a portion of the distal end of the pin 318 is retained within the port 325 of the side support structure 328. The port 325 is utilized to depress the pin 318 and, thus, compress the spring 323 during removal and/or replacement of the rotatable cutting element 302. During drilling operations, the spring 323 may facilitate the pin 318 being held in place within the support structure 320 by biasing the pin 318 against the side support structure 328 (FIG. 2) with or without the use of additional retention elements (e.g., braze material). Thus, the retention elements 322, 324 may provide sufficient force to retain the pin 318 within the support structure 320 under normal operating conditions, but the pin 318 may still be removed from the support structure 320, if necessary, for repair and/or replacement.

Rotatable cutting element assemblies as disclosed herein may have certain advantages over conventional rotatable cutting elements and over conventional fixed cutting elements. For example, support structures (i.e., auxiliary housings) may be installed into a bit body (e.g., by brazing) or integrally formed with the bit body or a blade thereof before the rotatable cutting elements are installed onto the support structures. Thus, the rotatable cutting elements, and particularly the PDC tables, need not be exposed to the high temperatures typical of brazing. Thus, installing rotatable cutting elements onto support structures already secured to a bit body may avoid thermal damage caused by brazing. In addition, because the edge of the cutting element contacting the formation changes as the rotatable cutting element rotates, the cutting edge remains sharp, avoiding the generation of a local wear flat. The sharp cutting edge may increase the rate of penetration while drilling formation, thereby increasing the efficiency of the drilling operation.

Furthermore, rotatable cutting elements and/or support structures as disclosed herein may be removed and replaced more easily, such as when the cutting elements are worn or damaged. Separation of rotatable cutting element from a support structure secured by retention elements (e.g., braze material) may be trivial in comparison to removal of cutting elements brazed directly into a bit body. For example, rotatable cutting elements may be removed, for example, by applying heat to the retention elements securing the cutting elements to the support structures. Alternatively, support structures may be removed by applying heat to the retention elements securing the support structures to the bit body. Similarly, insertion of a new cutting element may be effected rapidly and without damage to the drill bit. Thus, drill bits may be repaired more quickly than drill bits having conventional cutting elements.

Additional non-limiting example embodiments of the disclosure are described below.

Embodiment 1

A cutting element assembly, comprising: a support structure; a pin having a cylindrical exterior bearing surface; retention elements coupling opposing ends of the pin to the support structure; and a rotatable cutting element comprising a table of polycrystalline hard material having an end cutting surface and a supporting substrate, the rotatable cutting element having an interior sidewall defining a longitudinally extending through hole, wherein the pin is positioned within the through hole of the rotatable cutting element and is supported on the opposing ends thereof by the support structure.

Embodiment 2

The cutting element assembly of Embodiment 1, wherein the support structure comprises two opposing side support structures having a base therebetween, each of the two opposing side support structures extending generally transverse to the base.

Embodiment 3

The cutting element assembly of Embodiment 2, wherein at least a portion of the table of the rotatable cutting element is covered by one of the two opposing side support structures.

Embodiment 4

The cutting element assembly of Embodiment 2 or Embodiment 3, wherein a surface of the base adjacent the rotatable cutting element has a concave shape.

Embodiment 5

The cutting element assembly of any of Embodiments 2 through 4, wherein the base of the support structure is asymmetric with respect to a longitudinal axis of the rotatable cutting element.

Embodiment 6

The cutting element assembly of any of Embodiments 1 through 5, wherein the pin functions as at least one of a journal bearing or a roller bearing between the rotatable cutting element and the support structure.

Embodiment 7

The cutting element assembly of any of Embodiments 1 through 6, wherein the pin is fixed relative to the support structure and the rotatable cutting element is configured to rotate about a longitudinal axis thereof relative to the pin and the support structure.

Embodiment 8

The cutting element assembly of any of Embodiments 1 through 7, wherein the retention elements comprise at least one of a braze material, a threaded elements, a weld material, adhesive, or a snap ring.

Embodiment 9

An earth-boring tool, comprising: a body; and at least one cutting element assembly, comprising: a support structure; a pin having a cylindrical exterior bearing surface; retention elements coupling opposing ends of the pin to the support structure; and a rotatable cutting element comprising a table of polycrystalline hard material having an end cutting surface and a supporting substrate, the rotatable cutting element having an interior sidewall defining a longitudinally extending through hole, wherein the pin is positioned within the through hole of the rotatable cutting element and is supported on the opposing ends thereof by the support structure.

Embodiment 10

The earth-boring tool of Embodiment 9, wherein the body further comprises at least one cutting element pocket, the at least one cutting element assembly being located within the at least one cutting element pocket.

Embodiment 11

The earth-boring tool of Embodiment 9 or Embodiment 10, wherein the through hole of the rotatable cutting element extends entirely through the rotatable cutting element from a bearing surface of the supporting substrate to the end cutting surface of the table.

Embodiment 12

The earth-boring tool of Embodiment 11, wherein: a first end of the pin is supported by a first side support structure proximate the bearing surface of the supporting substrate; and a second end of the pin is supported by a second side support structure proximate the end cutting surface of the table.

Embodiment 13

The earth-boring tool of Embodiment 12, further comprising a first retention element and a second retention element, the second retention element being different than the first retention element, the first end of the pin being coupled to the first side support structure by the first retention element, and the second end of the pin being coupled to the second side support structure by the second retention element.

Embodiment 14

The earth-boring tool of Embodiment 13, wherein the at least one cutting element assembly further comprises a spring and a port, the spring being located between a protruding portion on the first end of the pin and an interior surface of a respective cutting element pocket, and the port is located in the second side support structure such that at least a portion of the second end of the pin is retained within the second side support structure.

Embodiment 15

The earth-boring tool of any of Embodiments 9 through 14, wherein the earth-boring tool comprises an earth-boring rotary drill bit, wherein the body comprises a bit body having a face including a cone region, a nose region, a shoulder region, and a gage region, and wherein the at least one cutting element assembly is located in the shoulder region or the gage region of the bit body.

Embodiment 16

A method of drilling a subterranean formation, comprising: applying weight-on-bit to an earth-boring tool disposed within a wellbore substantially along a longitudinal axis thereof and rotating the earth-boring tool; engaging a formation with a plurality of rotatable cutting elements located on blades of the earth-boring tool, wherein the plurality of rotatable cutting elements are rotatably secured within pockets of the blades with pins extending through a through hole of each of the plurality of rotatable cutting elements, each of the pins being coupled on opposing ends thereof to a support structure located within a respective pocket of the blades; and absorbing compressive forces imposed on the plurality of rotatable cutting elements with the support structure.

Embodiment 17

The method of Embodiment 16, wherein engaging the formation with the plurality of rotatable cutting elements further comprises utilizing each of the pins as a journal bearing between a respective rotatable cutting element and the support structure.

Embodiment 18

The method of Embodiment 16 or Embodiment 17, wherein engaging the formation with the plurality of rotatable cutting elements comprises rotating at least some of the plurality of rotatable cutting elements about an axis of rotation thereof responsive to frictional forces acting between the plurality of rotatable cutting elements and the formation when the earth-boring tool moves relative to the formation.

Embodiment 19

The method of any of Embodiments 16 through 18, further comprising engaging the formation with the plurality of rotatable cutting elements and a plurality of fixed cutting elements, each of the plurality of rotatable cutting elements and the plurality of fixed cutting elements comprising a table of polycrystalline hard material having an end cutting surface and a supporting substrate.

Embodiment 20

The method of Embodiment 19, wherein engaging the formation with the plurality of rotatable cutting elements comprises covering at least a portion of the table of polycrystalline hard material with a portion of the support structure.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of earth-boring tools.

What is claimed is:

1. A cutting element assembly, comprising:

a support structure;

a pin having a cylindrical exterior bearing surface;

retention elements coupling opposing ends of the pin to the support structure; and a rotatable cutting element comprising a table of polycrystalline hard material having an end cutting surface and a supporting substrate, the rotatable cutting element having an interior sidewall defining a longitudinally extending through hole, wherein the pin is positioned within the through hole of the rotatable cutting element.

2. The cutting element assembly of claim 1, wherein the support structure comprises two opposing side support structures having a base therebetween, each of the two opposing side support structures extending generally transverse to the base.

3. The cutting element assembly of claim 2, wherein at least a portion of the table of the rotatable cutting element is covered by one of the two opposing side support structures.

4. The cutting element assembly of claim 2, wherein a surface of the base adjacent the rotatable cutting element has a concave shape.

5. The cutting element assembly of claim 2, wherein the base of the support structure is asymmetric with respect to a longitudinal axis of the rotatable cutting element.

6. The cutting element assembly of claim 1, wherein the pin functions as at least one of a journal bearing or a roller bearing between the rotatable cutting element and the support structure.

7. The cutting element assembly of claim 1, wherein the pin is fixed relative to the support structure and the rotatable cutting element is configured to rotate about a longitudinal axis thereof relative to the pin and the support structure.

8. The cutting element assembly of claim 1, wherein the retention elements comprise at least one of a braze material, a threaded elements, a weld material, adhesive, or a snap ring.

9. An earth-boring tool, comprising:

a body; and at least one cutting element assembly, comprising:

a support structure;

a pin having a cylindrical exterior bearing surface;

retention elements coupling opposing ends of the pin to the support structure; and a rotatable cutting element comprising a table of polycrystalline hard material having an end cutting surface and a supporting substrate, the rotatable cutting element having an interior sidewall defining a longitudinally extending through hole, wherein the pin is positioned within the through hole of the rotatable cutting element.

10. The earth-boring tool of claim 9, wherein the body further comprises at least one cutting element pocket, the at least one cutting element assembly being located within the at least one cutting element pocket.

11. The earth-boring tool of claim 9, wherein the through hole of the rotatable cutting element extends entirely through the rotatable cutting element from a bearing surface of the supporting substrate to the end cutting surface of the table.

12. The earth-boring tool of claim 11, wherein:

a first end of the pin is supported by a first side support structure proximate the bearing surface of the supporting substrate; and a second end of the pin is supported by a second side support structure proximate the end cutting surface of the table.

13. The earth-boring tool of claim 12, further comprising a first retention element and a second retention element, the second retention element being different than the first retention element, the first end of the pin being coupled to the first side support structure by the first retention element, and the second end of the pin being coupled to the second side support structure by the second retention element.

14. The earth-boring tool of claim 13, wherein the at least one cutting element assembly further comprises a spring and a port, the spring being located between a protruding portion on the first end of the pin and an interior surface of a respective cutting element pocket, and the port is located in the second side support structure such that at least a portion of the second end of the pin is retained within the second side support structure.

15. The earth-boring tool of claim 9, wherein the earth-boring tool comprises an earth-boring rotary drill bit, wherein the body comprises a bit body having a face including a cone region, a nose region, a shoulder region, and a gage region, and wherein the at least one cutting element assembly is located in the shoulder region or the gage region of the bit body.

16. A method of drilling a subterranean formation, comprising:

applying weight-on-bit to an earth-boring tool disposed within a wellbore substantially along a longitudinal axis thereof and rotating the earth-boring tool;

engaging a formation with a plurality of rotatable cutting elements located on blades of the earth-boring tool, wherein the plurality of rotatable cutting elements are rotatably secured within pockets of the blades with pins extending through a through hole of each of the plurality of rotatable cutting elements, each of the pins being coupled on opposing ends thereof to a support structure located within a respective pocket of the blades; and absorbing compressive forces imposed on the plurality of rotatable cutting elements with the support structure.

17. The method of claim 16, wherein engaging the formation with the plurality of rotatable cutting elements further comprises utilizing each of the pins as a journal bearing between a respective rotatable cutting element and the support structure.

18. The method of claim 16, wherein engaging the formation with the plurality of rotatable cutting elements comprises rotating at least some of the plurality of rotatable cutting elements about an axis of rotation thereof responsive to frictional forces acting between the plurality of rotatable cutting elements and the formation when the earth-boring tool moves relative to the formation.

19. The method of claim 16, further comprising engaging the formation with the plurality of rotatable cutting elements and a plurality of fixed cutting elements, each of the plurality of rotatable cutting elements and the plurality of fixed cutting elements comprising a table of polycrystalline hard material having an end cutting surface and a supporting substrate.

20. The method of claim 19, wherein engaging the formation with the plurality of rotatable cutting elements comprises covering at least a portion of the table of polycrystalline hard material with a portion of the support structure.

* * * * *